US005083403A

United States Patent [19]

Otterbein, II

[11] Patent Number: 5,083,403

[45] Date of Patent: Jan. 28, 1992

[54] WORKPIECE SUPPORTING FIXTURE FOR USE WITH AN ABRASION TOOL TO FORM CIRCULAR WORKPIECES

[76] Inventor: Henry C. Otterbein, II, 653 Hidden Point La., Cincinnati, Ohio 45230

[21] Appl. No.: 590,984

[22] Filed: Oct. 1, 1990

[51] Int. Cl.[5] ..... B24B 41/06

[52] U.S. Cl. ..... 51/216 T; 51/240 T; 269/50

[58] Field of Search ..... 51/216 R, 216 T, 216 LP, 51/237 R, 240 T, 132, 106 R; 269/47, 48, 50, 51, 58

[56] References Cited

U.S. PATENT DOCUMENTS

| | | | |
|---|---|---|---|
| 1,109,405 | 9/1914 | Gianni | 51/237 R |
| 1,358,998 | 11/1920 | Stauder | 51/216 T |
| 3,936,983 | 2/1976 | Taylor | 51/216 T |

*Primary Examiner*—Roscoe V. Parker
*Attorney, Agent, or Firm*—Frost & Jacobs

[57] ABSTRACT

A workpiece supporting fixture pivotally mounted on the table of an abrasion tool enabling the manual shifting of the peripheral edge of the workpiece toward the powered abrasive element of the abrasion tool and the manual rotation of the workpiece with respect to the abrasive element to produce a true and repeatable circular peripheral edge on the workpiece. The fixture comprises a planar plate pivotally affixed to the tool stable and pivotable toward and away from the driven abrasive element. A pivot pin mountable on the fixture at a plurality of predetermined positions thereon, and receivable in a perforation in the workpiece, rotatably mounts the workpiece to the fixture. An arm is rigidly affixed to the fixture plate and extends beyond the edge of the tool table. A stop member is slidably and adjustably mounted on the arm and is fixable with respect thereto. The stop member is engageable with the edge of the tool table to limit the infeed of the fixture toward the abrasive element, enabling the production of circular workpieces of any diameter within the range of capability of the fixture.

15 Claims, 4 Drawing Sheets

WORKPIECE SUPPORTING FIXTURE FOR USE WITH AN ABRASION TOOL TO FORM CIRCULAR WORKPIECES

TECHNICAL FIELD

The invention relates to a workpiece supporting fixture for use on the table of an abrasion tool, having a powered abrasive element, the fixture enabling the production of true and repeatable circular peripheral edges on workpieces. More particularly, the invention relates to such a fixture which is easily adjustable to produce workpieces of any diameter within the range of capability of the fixture.

BACKGROUND ART

The making of a part having a circular peripheral edge has always been difficult when using only those tools one might expect to find in a home workshop. To make parts by hand with circular peripheral edges which are true and repeatable is virtually impossible.

U.S. Pat. No. 3,936,983 teaches a sanding fixture which solves this problem. The fixture is adapted to be mounted on the table of a powered disk sander, grinder or other power tool having a rotary abrasive wheel. In power tools of this type, the abrasive disk rotates in a fixed plane relative to the work supporting table. If the peripheral edge of the circular part is to be non-tapering, the abrasive wheel is oriented in a plane perpendicular to the plane of the work surface of the table.

The prior art fixture comprises a rectangular base plate mountable on the table. The base plate preferably has a longitudinal rib on its underside receivable in a guide slot in the tool table. Alternatively, in the absence of a guide slot the base plate can be securely located on the table with dowels, clamps or the like. A second plate is supported on the first plate and is parallel thereto. The second plate is pivotally affixed to the first plate so as to be shiftable toward and away from the rotary abrasive wheel in a plane perpendicular to the plane of rotation of the rotary abrasive wheel. The extent of pivotal movement of the second plate toward the rotary abrasive wheel is limited by its abutment against a stop mounted on the base plate. The second plate has a plurality of holes located at various distances from its edge which faces the rotary abrasive wheel. A pin may be located in any of these holes to determine the radius of the finished circular part. A roughly circular, oversize workpiece is provided with a central perforation. The second pivoted plate is shifted away from the rotary abrasive wheel by a distance sufficient to enable the workpiece hole to receive the workpiece mounting pin. Thereafter, the second plate is pivoted toward the rotating abrasive wheel until the workpiece engages the abrasive wheel. Pivoting of the second plate continues until it contacts the stop on the base plate, thereby determining the workpiece radius. At this point, the workpiece is rotated on the mounting pin until the entire periphery has been reduced to the desired radius.

Each of the pin mounting holes in the second plate represents a different final radius of the part. When it is desired to make a part with a radius other than the specific radii provided by the holes in the second plate, some sort of shim means must be provided for the stop.

The present invention is directed to an improved fixture of simplified construction which will enable the making of a circular part, the circular peripheral edge of which is true and repeatable. The part may have any radius within the size capability of the fixture, and without the necessity of making special shims or the like.

The fixture of the present invention may be mounted on the work supporting table of any appropriate powered abrasion tool such as a sanding disk, a sanding belt, a grinding disk, and the like. Therefore, while not so limited, for purposes of an exemplary showing the fixture of the present application will be described in its use with the table of a conventional, powered belt sander.

DISCLOSURE OF THE INVENTION

Accordingly, it is a primary object of the present invention to provide a fixture for use with a powered abrasion tool for forming parts with circular peripheral edges which are true and repeatable.

It is an object of the present invention to provide such a fixture of simplified construction comprising a single plate.

It is yet another object of the invention to provide such a fixture which is pivotally connectable directly to the tool table to avoid inaccuracies which might otherwise occur if the powered abrasive element is slightly out of parallelism with the adjacent edge of the tool table.

It is an object of the present invention to provide such a fixture with an adjustable stop enabling a full range of diameters for the parts to be produced, within the overall range of capability of the fixture.

It is an object of the invention to provide such a fixture with an extended range of capability.

It is yet another object of the invention to provide such a fixture which is reversible, so that it can be used by a right handed operator and a left handed operator with equal facility.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects and in accordance with the purposes of the present invention as described herein, an improved workpiece supporting fixture is provided for use with an abrasion tool to produce circular parts having true and repeatable circular peripheral edges. The fixture enables the manual shifting of the peripheral edge of the part toward the powered abrasive element of the abrasion tool, and the manual rotation of the part with respect to the abrasive element, to produce the desired circular peripheral edge.

The fixture comprises a planar plate pivotally mounted on the table of the abrasion tool and swingable toward and away from the driven abrasive element. The fixture plate is provided with a plurality of perforations into any one of which a pivot pit can be inserted. The rough cut part is provided with a perforation adapted to receive the pivot pin so that the part is rotatably mounted on the fixture. The fixture is provided with an outwardly extending rigid arm lying in the same plane as the fixture plate and extending beyond the adjacent edge of the tool table. A stop member is slidably mounted on the arm. The stop member is provided with a setscrew so that it can be fixed with respect to the arm at any desired position therealong. The stop member is engageable with the edge of the tool table to limit the infeed of the fixture, and thus the part, toward the abrasive element. Abutment of the stop element against the adjacent table edge determines the final diameter of the workpiece. Since the stop is adjustable with respect to the arm, the workpiece may have any diameter within the range of capability of the fixture.

BRIEF DESCRIPTION OF THE DRAWINGS

The accompanying drawings incorporated in and forming a part of the specification illustrate several aspects of the present invention and together with the description serve to explain the principles of the invention. In the drawings.

DETAILED DESCRIPTION OF THE INVENTION

Figure 1:
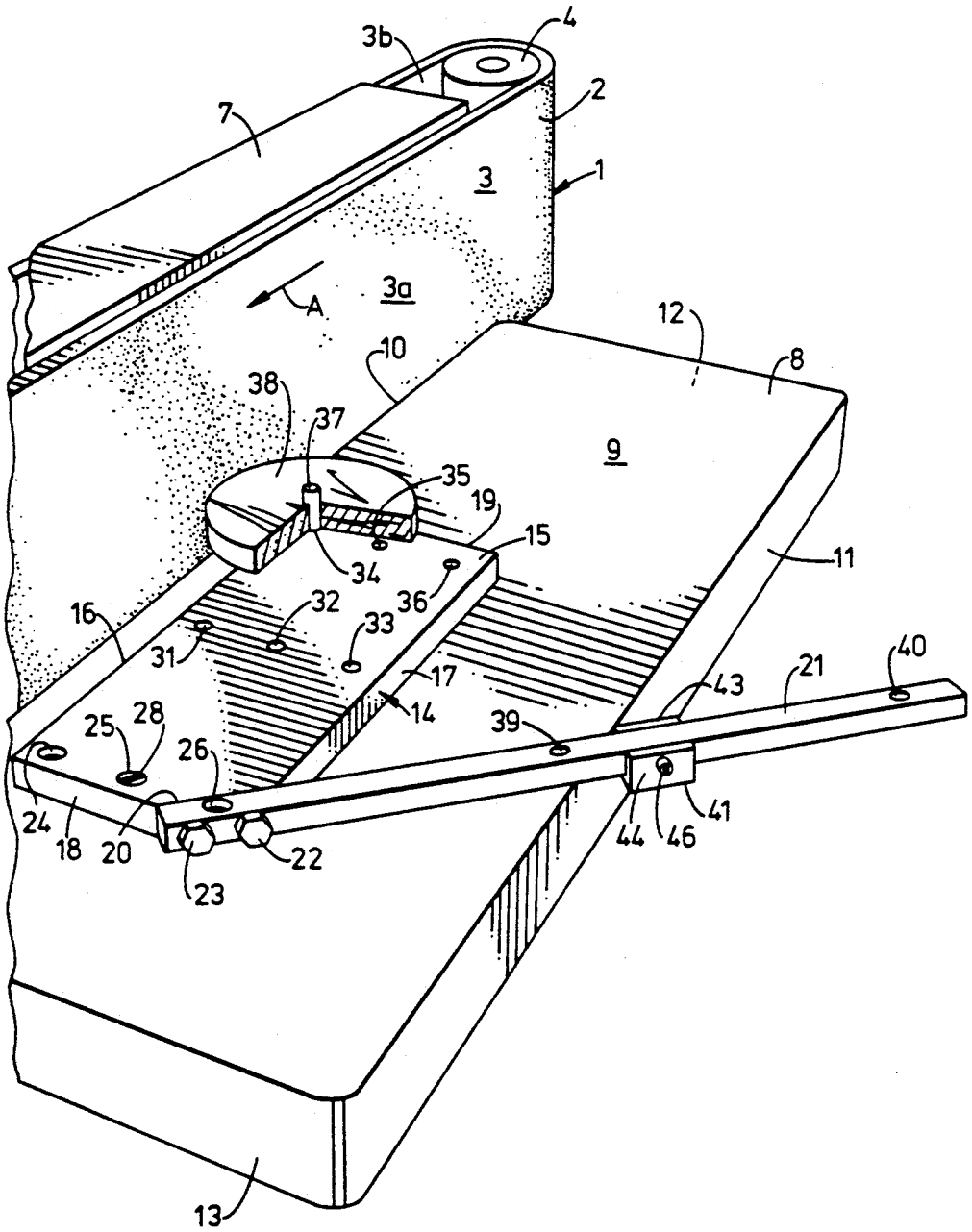
FIG. 1 is a fragmentary perspective view illustrating a conventional abrasion tool of the type having a powered sanding belt and a work supporting table, with the fixture of the present invention pivotally affixed to the table.

FIG. 1 illustrates a conventional, exemplary abrasion tool, generally indicated at 1. The tool comprises a continuous sanding belt 2 having an abrasive exterior surface 3. The sanding belt 2 is mounted on a pair of support rollers 4 and 5 (see FIGS. 1 and 4). At least one of the rollers 4 and 5 is powered to cause the sanding belt to move longitudinally in an appropriate direction, such as the direction of Arrow A. The sanding belt 2 has a working flight 3*a* and a return flight 3*b*. Between the flights 3*a* and 3*b*, and between the rollers 4 and 5 the tool is provided with a backing or support block 7 for the sanding belt working flight 3*a*. The at least one driven roller 4 or 5 is operatively connected to an appropriate prime mover (not shown) such as an electric motor or the like.

The tool 1 is provided with a workpiece supporting table 8. The workpiece supporting table 8 is generally rectangular and is provided with a planar upper surface 9. The table 8 has an inner longitudinal edge 10 which faces the working flight 3*a* of sanding belt 2 and lies in parallel spaced relationship thereto. The table 8 has a corresponding outer longitudinal edge 11, together with end edges 12 and 13.

It will be noted that the working flight 3*a* of sanding belt 1 is vertically oriented. The upper surface 9 of table 8 is horizontally oriented. As a consequence, the working flight 3*a* and the table surface 9 are perpendicular with respect to each other, producing a cylindrical circular edge on the part, as will be described hereinafter. It is within the scope of the invention to cause the working flight 3*a* and table surface 9 to have a relationship other than perpendicular. As will be apparent to one skilled in the art, if this is the case, the edge produced on the part will be circular and tapered at an angularity corresponding to the angularity between working flight 3*a* and table surface 9.

Figure 2:
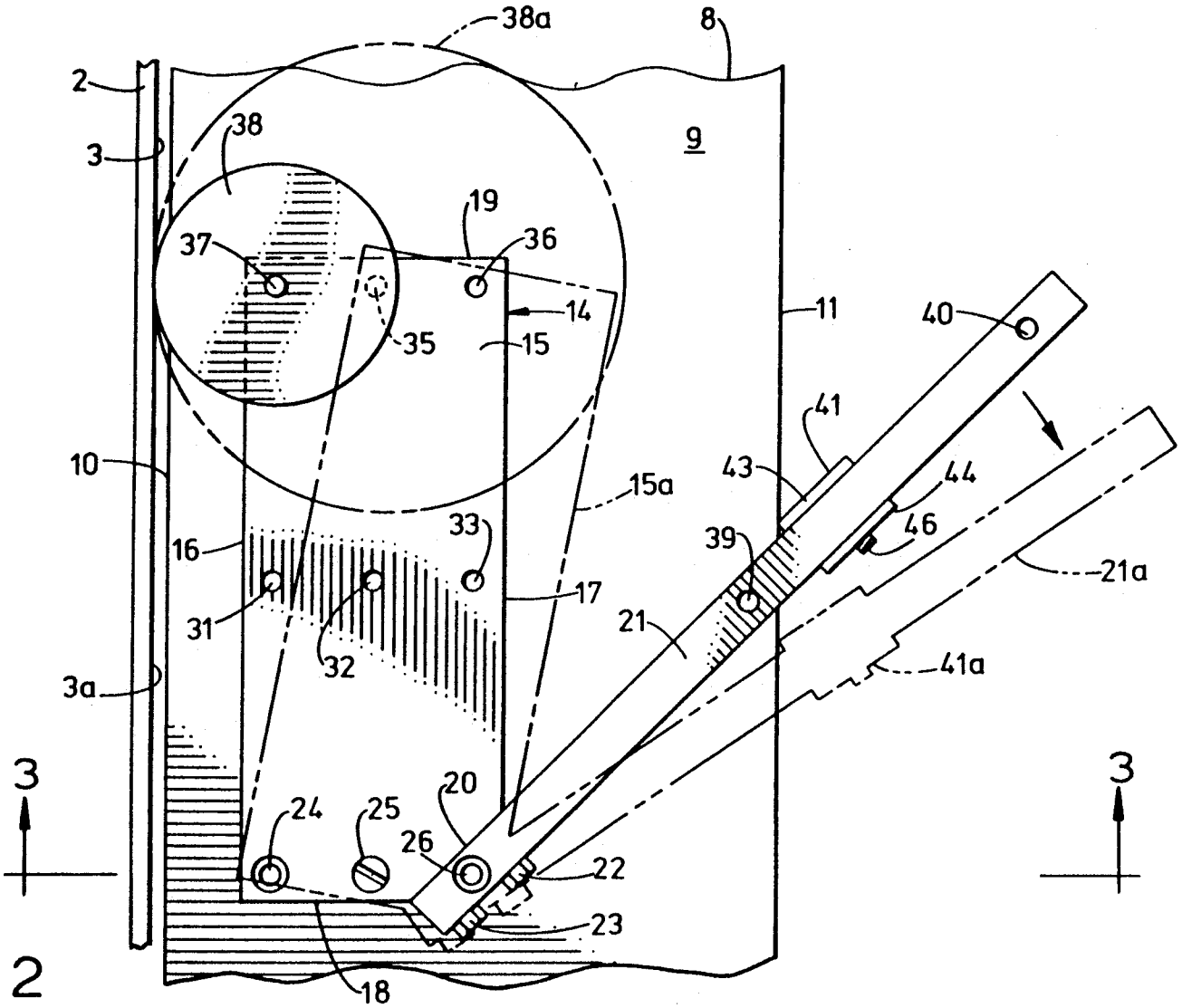
FIG. 2 is a fragmentary plan view of the structure of FIG. 1, illustrating in solid lines the fixture of the present invention and a completed small diameter part, and in broken lines the fixture of the present invention and a completed larger diameter part.

Reference is now made to FIGS. 1 and 2. The fixture of the present invention is generally indicated at 14 and comprises a planar, plate-like member 15. The peripheral configuration of plate 15 is not a limitation of the present invention. Preferably, the plate 15 is rectangular having a pair of longitudinal edges 16 and 17 and a pair of end edges 18 and 19. That corner of plate 15 between end edge 18 and longitudinal edge 17 is relieved to form an angled edge 20. An elongated arm 21 is rigidly affixed to the edge surface 20 by a pair of machine bolts 22 and 23.

The angularity of edge 20 with respect to end edge 18 and longitudinal edge 17 is not limiting. Preferably, however, the edge 20 lies at an angle of about 45° to end edge 18 and to longitudinal edge 17, with the result that the arm 21 also lies at an angle of about 45° to longitudinal edge 17. It will be noted that the arm 21 is of rectangular cross-section and has a thickness equal to the thickness of plate 15. The purpose of arm 21 will be apparent hereinafter.

Figure 3:
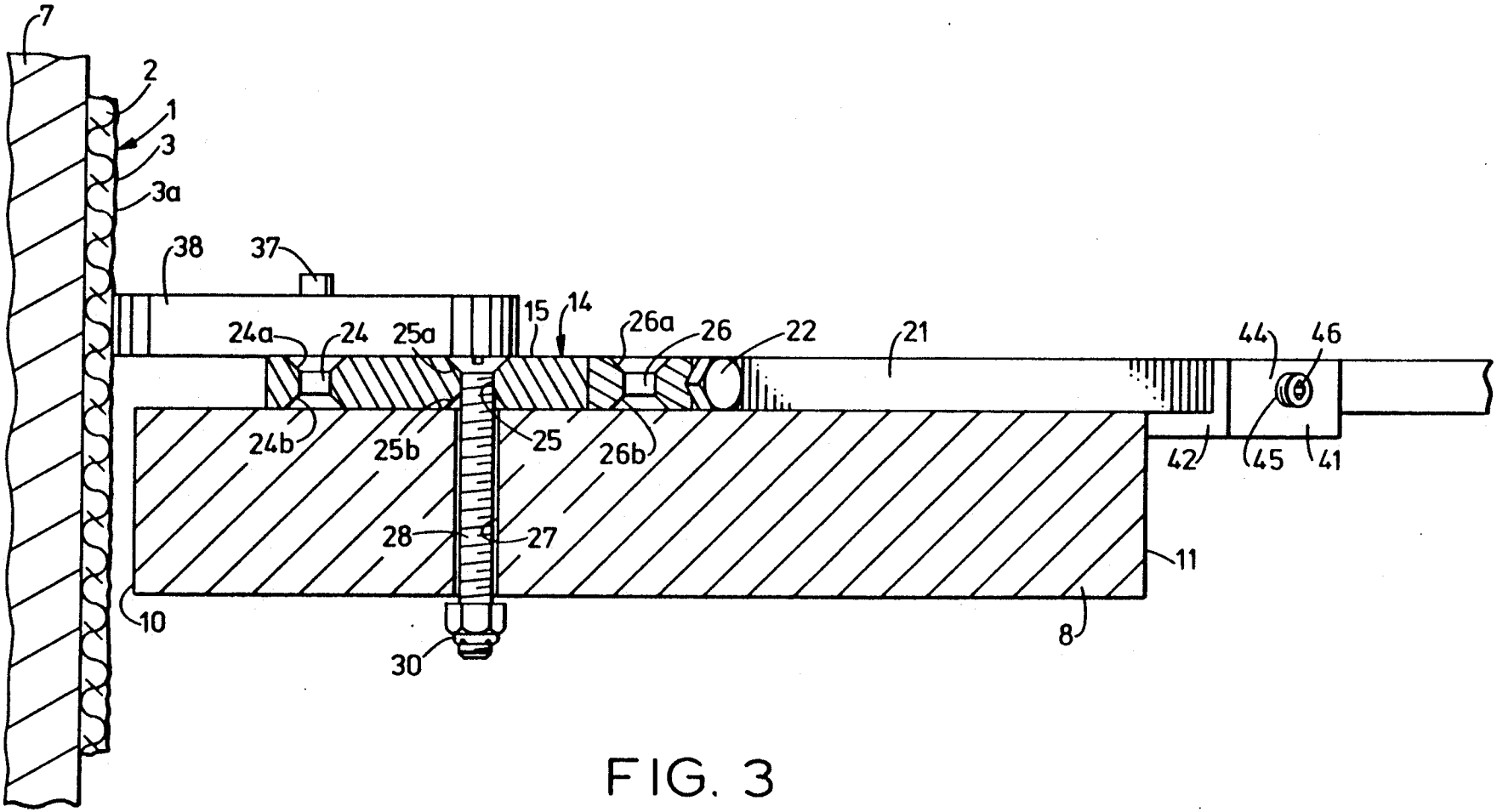
FIG. 3 is a cross-sectional view taken along section line 3—3 of FIG. 2.

The fixture 14, adjacent end edge 18, is provided with three evenly spaced and aligned perforations 24, 25 and 26. It will be noted that perforation 26 is formed in the arm 21. The perforations 24, 25 and 26 serve as alternate pivot points for the fixture 14. Reference is made to FIG. 3. In FIG. 3, the perforation 25 was selected as the pivot point and an appropriate bore 27 was drilled in table 8. The fixture 14 is pivotally attached to table 8 by a flathead machine screw 28. The machine screw 28 passes with clearance through the bore 27 and is provided with a lock nut 30. It will be noted that perforation 25 is countersunk as at 25*a* to accommodate the head of machine screw 28 so that the machine screw head will be flush with or slightly beneath the upper surface of fixture plate 15. It will be understood that if one of bores 24 and 26 had been selected as the fixture pivot point, an appropriate bore (similar to bore 27) would have been drilled in table 8 therefor. It will also be noted that perforations 24 and 26 are countersunk as at 24*a* and 26*a* to accommodate the head of machine screw 28. It will further be noted that the other ends of bores 24, 25 and 26 are countersunk, as at 24*b*, 25*b* and 26*b*. The purpose of these counter sinks will be apparent hereinafter.

Returning to FIGS. 1 and 2, it will be noted that the plate 15 of Fixture 14 is provided with a series of perforations 31, 32 and 33 evenly spaced and aligned transversely across the plate 15, centrally thereof. In similar fashion, another set of perforations 34, 35 and 36, similar to the set of perforations 31, 32 and 33, is located adjacent the end edge 19 of plate 15. A pivot pin 37 is adapted to be received in any one of the perforations 31 through 36. The pivot pin 37 is adapted to rotatively mount a part on fixture 14 with a portion of its peripheral edge facing the working flight 3*a* of sanding belt 2. For purposes of an exemplary showing, the pivot pin 37 is illustrated in FIGS. 1-3 as being located in perforation 34, supporting a part 38. The selection of one of perforations 24-26 to serve as a pivot point for the fixture 14 depends on the size of the parts to be made and the construction of table 8. The selection of one of perforations 31-36 as a mount for pivot pin 37 depends upon the size of the parts to be made and the amount of material needed to be removed from each part to achieve that size. Selection of one of perforations 31–36 is also preferably made so that plate 15 can provide maximum support for the part. When a sanding disc is used, selection of one of perforations 31–36 may also be made (depending on the direction of rotation of the disc) such that the sawdust created will be directed downwardly rather than upwardly.

It will be remembered that the top surface of arm 21 is co-planar with the upper surface of plate 15. The arm 21 is provided with a series of perforations. For purposes of an exemplary showing, arm 21 is illustrated as having a pair of perforations 39 and 40. When making large diameter circular products, the pin 37 can be located in either of these perforations.

The fixture 14 of the present invention is completed by the provision of a U-shaped stop 41 mountable on and slidable along arm 21. The U-shaped stop 41 has a base portion 42 and a pair of upstanding legs 43 and 44. The arm 21 is adapted to be received between legs 43 and 44, which legs do not extend above the upper surface of arm 21 (see FIG. 4). The leg 44 is provided with a threaded perforation 45 adapted to receive a set screw 46. The stop 41 may be slid along the arm 21 to any desired position, and locked in that position by means of set screw 46 and an appropriate Allen wrench or the like. It is within the scope of the invention to provide one or both of the stop legs 43 and 44 with a longitudinally extending key, receivable in a slot or keyway formed in the adjacent side of arm 21. In this way, the stop is releasably, but captively mounted on the arm for convenience.

The fixture of the present invention having been described in detail, its method of use can now be set forth. A circle of the desired size The fixture of the present invention having been described in detail, the manner of its use can now be set forth. A circle of the desired size is laid out on a workpiece and a hole is drilled in the workpiece at the center of the circle. The hole is of such size as to receive pivot pin 37 so that the workpiece is rotatable thereabout. If desired, the workpiece can be trimmed on an appropriate jigsaw, band saw, or with a sabre saw or the like so that its rough peripheral edge is somewhat larger than the desired peripheral edge of the product. The fixture 14 is pivotally mounted on table 8 by machine screw 28 and the pivot pin 37 is located in the desired one of perforations 31–36, 39 or 40. The workpiece is mounted on pivot pin 37 and the fixture 14 is located in such a pivotal position that the edge of the workpiece is out of contact with the working flight 3*a* of sanding belt 2.

At this point, the belt sander is turned on, causing sanding belt 2 to be driven thereabout. The workpiece is manually engaged and kept from rotating about pivot pin 37. The workpiece and the fixture are shifted toward the working flight 3*a* of sanding belt 2 and the workpiece is caused to engage working flight 3*a* of sanding belt 2. The sanding belt 2 wears the material away until it reaches circle drawn on the workpiece. At this point, the belt sander 1 is turned off. The workpiece is held against the sanding belt and the stop 41 is shifted along the arm 21 until it engages the outer longitudinal edge 11 of table 8. At this point, the stop is fixed in position on arm 21. This precludes the fixture and the workpiece from shifting further toward sanding belt 2. In this manner, the diameter of the finished part is determined.

The belt sander 1 is turned on again, and the fixture is maintained in its desired position determined by stop 41. At the same time, the workpiece is slowly rotated manually about pivot pin 37 until it achieves its final desired full circular peripheral edge.

Another way of determining the desired final diameter of the product is to take a ruler and but it against the sanding belt of the belt sander with the belt sander turned off. The fixture is then pivoted until the center of pivot pin 37 is the desired distance from the working flight of the sanding belt (i.e., the desired radius of the final product). The stop 41 is then shifted into contact with the table edge 11, fixing the distance between the center of pivot pin 37 and the working flight 3*a* of sanding belt 2. A roughly cut, oversize workpiece is mounted on the pivot pin 37. The fixture is shifted to a position wherein the workpiece does not contact sanding belt 2. The belt sander 1 is turned on and, with the workpiece manually held against rotation, the fixture and workpiece are shifted toward working flight 3*a* of sanding belt 2 until stop 41 engages the table edge 11. Maintaining this engagement, the workpiece is then slowly rotated until the desired circular peripheral edge is produced thereon.

Once the distance between the center of pivot pin 37 and the surface of the working flight 3*a* of sanding belt 2 is determined either by trial-and-error, or by premeasurement, and set by stop 41, a series of workpieces can be sanded in the manner described above and the final products will be identical, each having the same true circular peripheral edge.

In FIG. 2 the fixture 14 is shown in solid lines together with a completed small diameter part 38. The fixture is also shown in broken lines (with like parts given the same index numerals followed by "a") together with a completed larger diameter part 38*a*.

Figure 4:
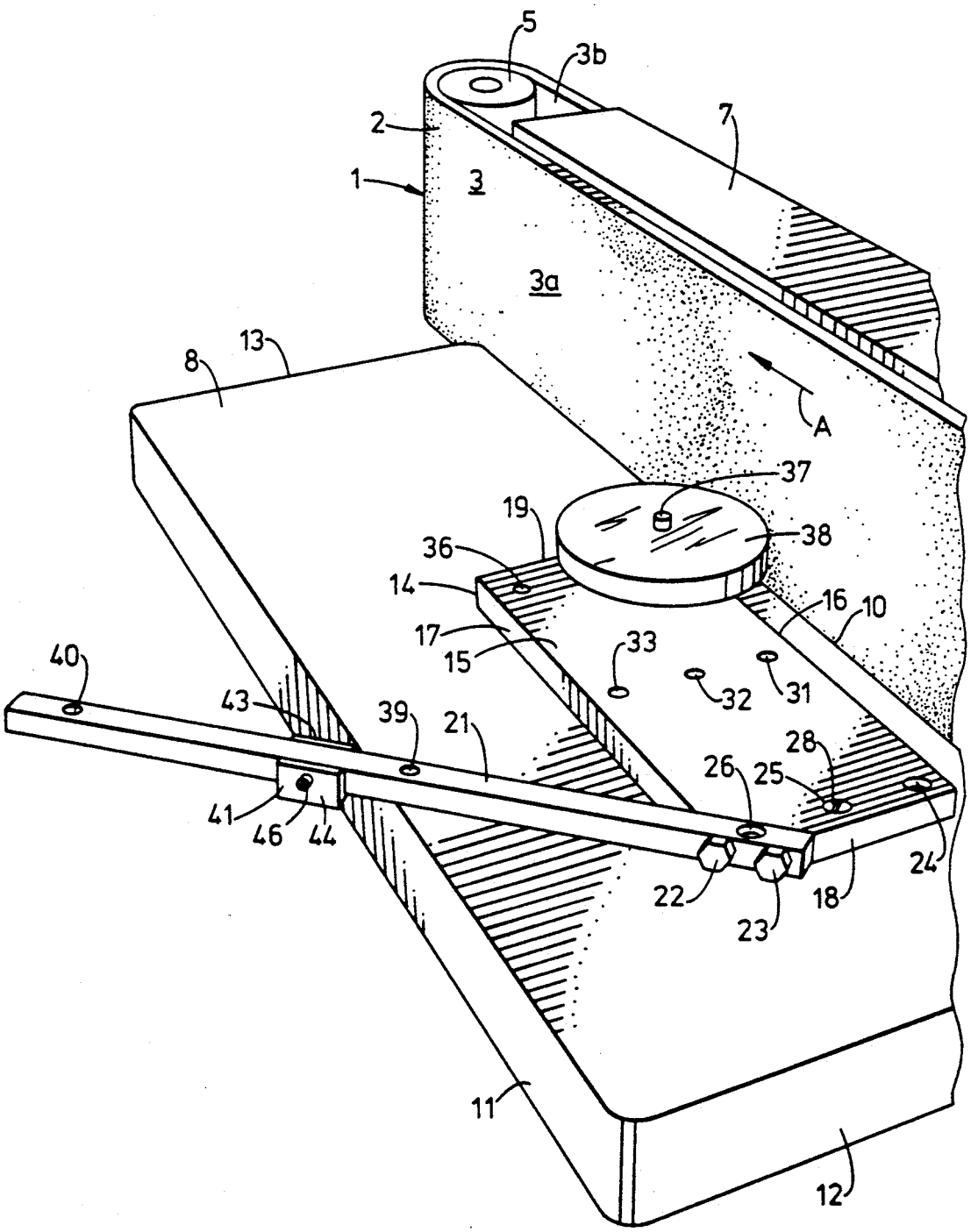
FIG. 4 is a fragmentary perspective view, similar to FIG. 1, but viewed from the opposite end of the tool table with the fixture of the present invention reversed thereon.

As illustrated in FIGS. 1, 2 and 3, the fixture of the present invention is set up for use by a right-handed operator. It will be remembered that perforations 24, 25 and 26 are countersunk at both ends 24*a*–24*b*, 25*a*–25*b* and 26*a*–26*b*. This enables the entire fixture to be turned over on table 8 so that what used to be the top surface of plate 15 becomes the bottom surface. This is illustrated in FIG. 4 wherein the fixture is now set up for a left-handed operator. This conversion is completed by removing stop 41 and replacing it on arm 21 so that the free ends of the stop legs face upwardly. The use and operation of the fixture is otherwise identical, the pivot pin being locatable in any one of perforations 31–36, 39 and 40.

It would be within the scope of the invention to use a tool table having a slot therein extending longitudinally thereof. Such slots are sometimes produced for use with a meter gage or the like. In such an instance, the plate 15 could be pivotally affixed by a machine screw to a narrow block receivable within the slot. This would enable the fixture to be shifted longitudinally of the tool table. If the abrasion tool was of the type having a sanding disc, rather than a sanding belt, the longitudinal shifting of the fixture would enable the use of the full surface of the sanding disc. It is preferred, however, to pivotally attach the plate 15 directly to the table as shown in FIG. 3. If the fixture is longitudinally shiftable, an error can be introduced into the products if the plane of the abrasion means and the adjacent edge of the table are slightly non-parallel.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A fixture adapted for use with an abrasion tool having a work table and an abrasive element that is moveable with respect to the work table, said fixture comprising a fixture base, said fixture base being pivotally mounted to a work table, said fixture base being swingable along a path of movement toward and away from an abrasive element, a workpiece support pin secured to said fixture base for rotatably supporting a workpiece relative thereto, the workpiece support pin extending in a direction generally parallel to the abrasive element and being operative to carry a peripheral edge surface of the workpiece into selective engagement with the abrasive element, an arm rigidly secured to said fixture base, said arm extending outwardly from said fixture base beyond the edge of the work table, and a stop member slidably mounted on said arm, said stop member being adapted to engage the edge of the work table and limit infeed movement of said fixture toward the abrasive member in accordance with the relative position of said stop member on said arm, whereby the maximum amount of workpiece infeed movement into the abrasive element may be varied by adjusting said stop member relative to said arm.

2. The fixture claimed in claim 1 wherein said fixture base comprises an elongated, planar, plate-like member having first and second ends, said fixture base having near said first end at least one bore formed therethrough, said bore having a countersunk upper end, a flathead machine bolt receivable in said bore and in a bore in a work table to pivotally affix said fixture base to the work table.

3. The fixture claimed in claim 1 wherein said fixture base comprises an elongated, planar, plate-like member, said fixture base being reversible with respect to a work table whereby said fixture can be used by left and right handed operators with equal facility.

4. The fixture claimed in claim 1 wherein said fixture base comprises a rectangular, planar, plate-like member having first and second end edges and first and second longitudinal side edges, said fixture base being pivotally affixable to a work table near said first end edge of said fixture base, said fixture base having a plurality of perforations therethrough, said workpiece support pin being mountable in any one of said perforations.

5. The fixture claimed in claim 1 wherein said fixture base comprises a rectangular, planar, plate-like member having first and second end edges and first and second longitudinal side edges, said fixture base being pivotally affixable to a work table near said first end edge of said fixture base, said first longitudinal edge of said fixture base being located near an abrasive element, said second longitudinal edge of said fixture base being remote from the abrasive element, said fixture base having a relief at the juncture of said first end edge and said second longitudinal side edge forming an angled edge therebetween, said arm being rigidly attached to said angled edge, said arm lying at an acute angle to said second fixture base longitudinal edge.

6. The fixture claimed in claim 1 wherein said fixture base comprises a rectangular, planar, plate-like member having first and second end edges and first and second longitudinal side edges, at least two bores formed through said fixture base arranged in a transverse row parallel to and near said first end edge thereof, each of said bores having a countersunk end, a flathead machine bolt receivable in any one of said at least two bores in said fixture base and in a corresponding bore in a work table to pivotally affix said fixture base to the work table.

7. The fixture claimed in claim 4 wherein said support pin perforations in said base are arranged in a first transverse row parallel to and near said second base end edge and a second transverse row parallel to said first row and intermediate said fixture base end edges.

8. The fixture claimed in claim 4 wherein said first longitudinal side edge of said fixture base is located near an abrasive element, said second longitudinal side edge of said fixture base being remote from the abrasive element, said fixture base having a relief at the juncture of said first end edge and second longitudinal side edge forming an angled edge therebetween, said arm being rigidly attached to said angled edge, said arm lying at an acute angle to said second fixture base longitudinal side edge.

9. The fixture claimed in claim 5 wherein said arm is coplanar with said fixture base and of the same thickness as the fixture base.

10. The fixture claimed in claim 8 including at least two bores formed through said fixture base, arranged in a transverse row parallel to and near said first end edge thereof, each of said bores having a countersunk end, a flathead machine bolt receivable in any one of said at least two bores in said fixture base and in a corresponding bore in a work table to pivotally and adjustably affix said fixture base to the work table.

11. The fixture claimed in claim 9 including at least two workpiece support pin receiving perforations in said arm.

12. The fixture claimed in claim 10 wherein said support pin perforations in said base are arranged in a first transverse row parallel to and near said second base end edge and a second transverse row parallel to said first row and intermediate said fixture base end edges.

13. The fixture claimed in claim 12 wherein said bores in said fixture base for said flathead machine bolt are countersunk at both ends, said fixture base being reversible with respect to a work table whereby said fixture can be used by left and right handed operators with equal facility.

14. The fixture claimed in claim 13 wherein said arm is coplanar with said fixture base and of the same thickness as the fixture base.

15. The fixture claimed in claim 14 including at least two workpiece support pin receiving perforations in said arm.

* * * * *